US005555781A

United States Patent [19]

Pool et al.

[11] Patent Number: 5,555,781

[45] Date of Patent: Sep. 17, 1996

[54] DRIVER OR BIT CONSTRUCTION

[75] Inventors: James L. Pool, Clarinda, Iowa; Robert A. Muto, Thompson; Ronald J. Perkins, Willoughby, both of Ohio

[73] Assignee: The Lisle Corporation, Clarinda, Iowa

[21] Appl. No.: 393,227

[22] Filed: Feb. 23, 1995

[51] Int. Cl.[6] ..... B25B 23/00; B25B 23/16

[52] U.S. Cl. ..... 81/436; 81/177.5

[58] Field of Search ..... 81/436, 439, 437, 81/121.1, 124.3, 125, 177.5, 177.8

[56] References Cited

U.S. PATENT DOCUMENTS

D. 45,165 1/1914 Warren ..... 81/436

4,827,812 5/1989 Markovetz ..... 81/177.5

4,934,221 6/1990 Hsiao ..... 81/177.5

4,976,173 12/1990 Yang ..... 81/177.8

*Primary Examiner*—Willis Little

*Attorney, Agent, or Firm*—Banner & Allegretti, Ltd.

[57] ABSTRACT

A bit construction for use in restricted work spaces includes a preformed cap member having a center axial counterbore for receipt of cylindrical bit member having a shaped end that projects outwardly from the cap member and defines a bit for engaging a fastener and acting as a driver. A specific brazing operation enables assembly of the component parts to provide a useful bit construction.

6 Claims, 2 Drawing Sheets

6
32
6

42
40
32

46
41
44
43
30

34

43

36
41
40
34
b
a
38

DRIVER OR BIT CONSTRUCTION

BACKGROUND OF THE INVENTION

This invention relates to an improved bit construction and, more particularly, to a bit construction which is especially useful in a restricted work space.

Almost all machinery and equipment are assembled by means of fasteners such as bolts, screws and the like. Such fasteners are typically headed to define a polygonal shape or with an internal recess which allows the fasteners to be driven by various types of tools, such as wrenches, bits, etc. Automobile assembly utilizes numerous types of fasteners particularly in assembly of the engine and related components housed in the engine compartment of the vehicle. One type of fastener that enjoys popularity in the automotive field is known by the trade name as a TORX fastener. TORX fasteners have a proprietary configuration associated with the fastener head, as exemplified and disclosed in U.S. Pat. Nos. 4,269,246 and 3,763,725, for example. The owner of the TORX technology has extensively licensed that technology as well as the trademark, TORX, associated therewith. As a result, TORX brand fasteners are especially popular in the original equipment automotive industry. The automotive aftermarket has thus developed a need to provide various drivers and bit constructions useful to drive TORX fasteners. This invention relates to a bit construction useful for driving fasteners having a head with a recess therein for receipt of the bit including, most especially fasteners having a recess configured in accord with the TORX brand technology.

A problem often encountered with respect to automotive fasteners results from restricted access to the fasteners particularly in automobile engine compartments. Proposals have been made to improve the accessibility of such fasteners by developing specialized bit constructions. For example, fastener bits have been developed which may be engaged by a bit holder which, in turn, coacts with a wrench driver. In this manner, a series of bits of various sizes may be utilized in combination with a standard, single bit holder and a single wrench handle. This arrangemere, though useful, still is difficult to use in a restricted work space. In order to overcome these drawbacks, the present invention was devised and is especially useful with TORX type bit drivers of the type designed to engage a shaped recess in the head of a fastener.

SUMMARY OF THE INVENTION

Briefly, the present invention comprises a bit construction for use in highly restricted access areas. The device includes a bit member having a cylindrical shaft with a shaped end to serve as a fastener driver and an opposite, cylindrical end. A separate cap member includes a centerline counterbore for receipt of the cylindrical end of the bit member. The cap member has a polygonal external configuration thereby enabling it to be actuated by a standard wrench. The cylindrical end of the bit member is brazed or soldered in the counterbore of the cap member in a manner which provides an improved bond and also serves to appropriately heat treat the component parts. A standard size cap member is used with multiple sizes of bit drivers whereby a standard, single size wrench may be used for multiple bit driver sizes. The longitudinal or axial dimension of the bit construction is minimized and need not exceed double the axial dimension of the thickness of the wrench jaws or cap member for the bit construction.

Thus, it is an object of the invention to provide an improved bit construction for driving engagement with the recess of a headed fastener.

It is a further object of the invention to provide an improved bit construction especially useful for restricted access work areas.

Another object of the invention is to provide a bit construction comprised of a bit member having a cylindrical shank with a shaped end for engaging a fastener and a separate cap member brazed to the opposite end of the shank, the cap member having an external polygonal configuration.

Another object of the invention is to provide an improved bit construction which is easily manufactured and which includes a construction resistive to bending, binding, breaking or fracture during operation.

These and other objects, advantages and features of the invention will be set forth in the detailed description which follows.

BRIEF DESCRIPTION OF THE DRAWING

In the detailed description which follows, reference will be made to the drawings comprised of the following figures.

DESCRIPTION OF THE PREFERRED EMBODIMENT

Figure 1:
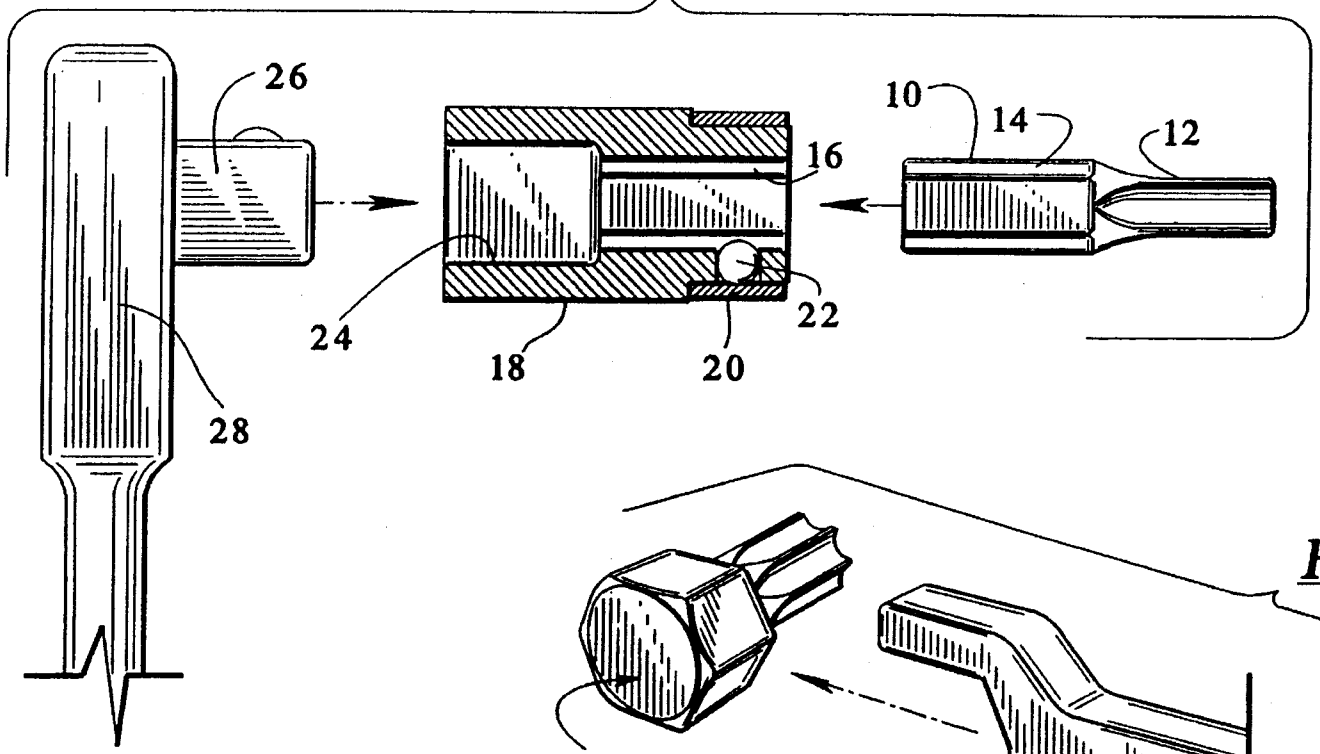
FIG. 1 PRIOR ART
FIG. 1 is a side cross sectional view of a typical prior art bit construction which is not useful in highly restricted access areas.

FIG. 1 illustrates a typical prior art construction. The bit assembly of FIG. 1 includes a bit member 10 having a shaped end 12, which may typically be shaped in accord with TORX technology. The bit member 10 is typically made from hexagonal stock 14. The hexagonal stock 14 is sized to fit into a hexagonal opening 16 in a bit holder 18. A flat spring 20 engages a ball 22 in the holder 18. The ball 22 is, thus, biased into a circumferential slot 19 in stock 14 to retain the hex stock 14 in the opening 16 of holder 18. The opposite end of the holder 18 includes a polygonal recess 24 for receipt of a drive member 26 associated with a wrench handle 28. Typically, the recess 24 has a square cross section.

The prior art construction of FIG. 1 enables substitution of various sizes of bit members 10 in the holder 18. Thus, the size of the TORX bit end 12 of the bit member 10 may be varied according to need. The assembly of FIG. 1 presents a fairly narrow axial dimension. That is, the axial extent of the assembly or distance between end 12 and the opposite end of holder 18 is minimal. Nonetheless, this particular fastener combination does not easily fit into many restricted work spaces, particularly in automobile engine compartments.

Figure 9:
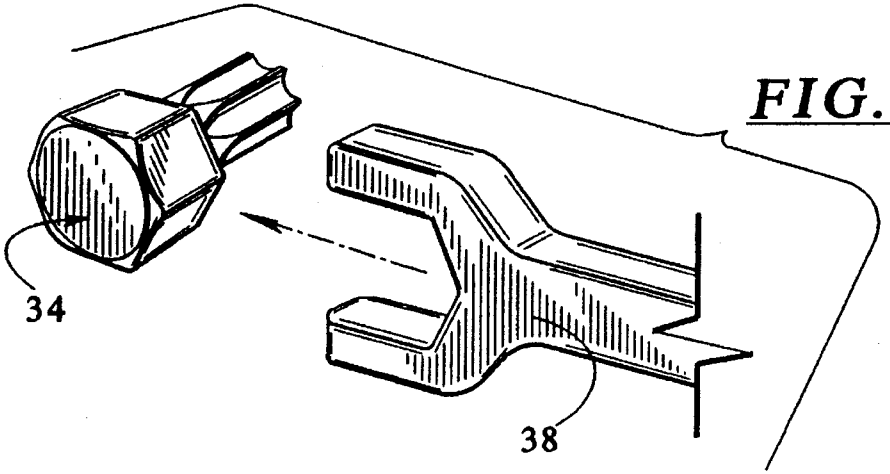
FIG. 9 is an isometric view of a manner of use of the bit construction in a restricted access area.
Figures 2, 3, 4, 5, 6, 7, 8:
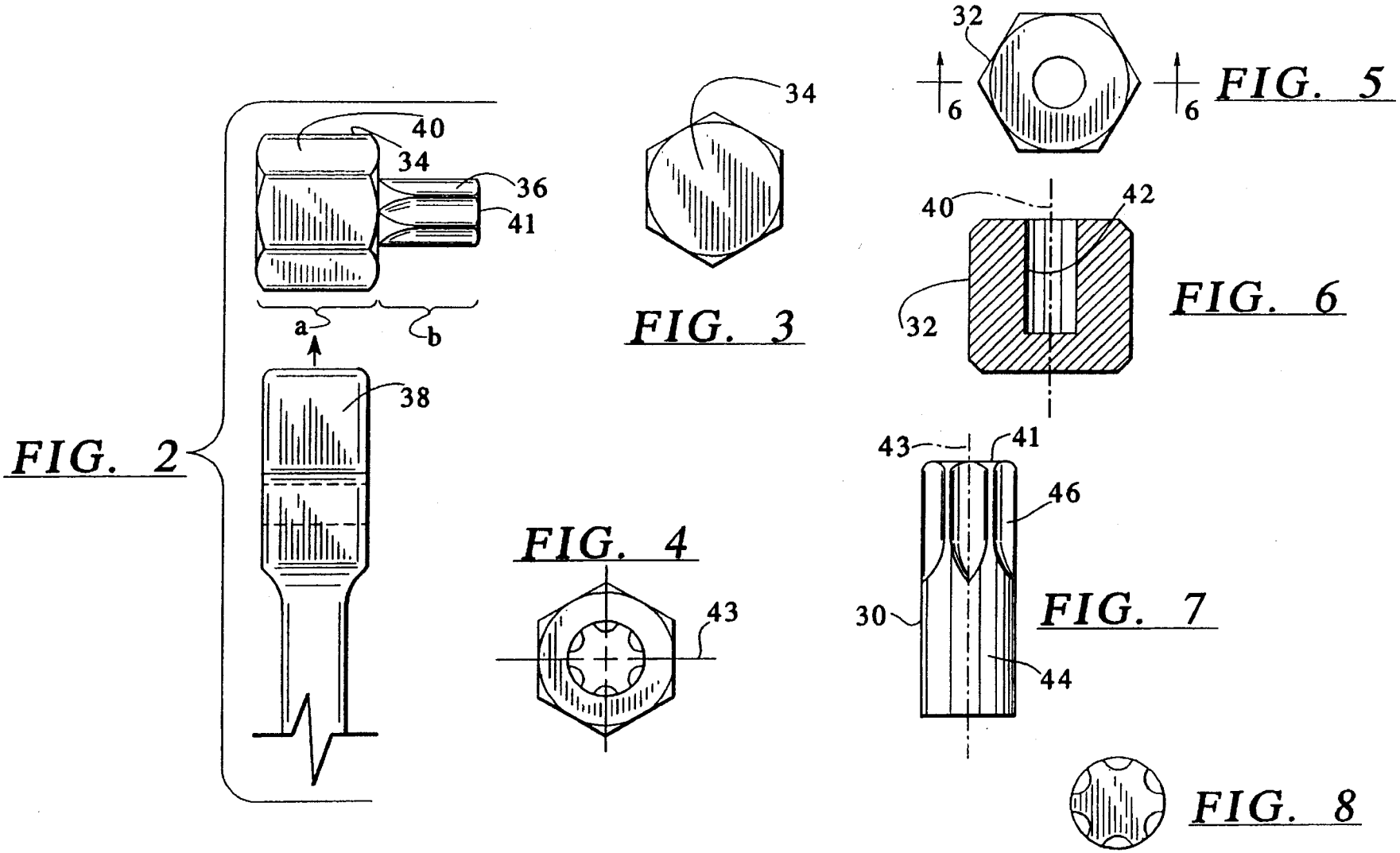
FIG. 2 is a side view of the improved bit construction of the invention.
FIG. 3 is an end view of the bit construction of FIG. 2.
FIG. 4 is an opposite end view of the bit construction of FIG. 2.
FIG. 5 is an end view of the cap member of the bit construction of FIG. 2.
FIG. 6 is a side cross sectional view of the cap construction of FIG. 5 taken along the line 6—6.
FIG. 7 is a side view of the bit member of the bit construction of FIG. 2.
FIG. 8 is an end view of the bit member of FIG. 7.

The remaining FIGS. 2 through 9 illustrate the improved construction 34 of the present invention which has a significantly reduced axial dimension. Referring to these figures, the bit construction 34 includes a bit member 30 which is depicted more completely in FIGS. 7 and 8. Bit member 30 coacts with a cap member 32 in FIGS. 5 and 6 to define an assembled bit construction 34 depicted in FIGS. 2 through 4. FIG. 9 illustrates the manner of use of the bit construction. Thus, the assembled bit construction 34 includes a shaped or bit end 36 which has a specific driver configuration, for example, a TORX driver configuration. The cap 32 defines an end which may be surrounded so as to be engaged and driven by a wrench 38 inasmuch as the cap 32 has a polygonal configuration 40. The size of the bit may be embossed on the cap 32 as depicted in FIG. 3. For example, size T50 TORX fastener is indicated as depicted in FIG. 3.

Referring now to FIGS. 5 and 6, the construction of the cap 32 is depicted in greater detail. The cap 32 has a hexagonal outer configuration. A centerline axis 40 is defined through the cap 32. A cylindrical recess or counterbore 42 lies on the centerline axis 40 and extends into the cap 32 approximately to a depth of seventy (70) to eighty (80) percent of the thickness of the cap 32 along the axis 40.

Referring now to FIGS. 7 and 8, the bit member 30 is fashioned from cylindrical stock and, thus, includes a cylindrical end 44 and a TORX bit end 46 terminating in a transverse planar surface 41. The cylindrical stock end 44 is sized to fit within the cylindrical recess 42 of cap 32 and has a radial dimension in the range of 0.002" to 0.006" less than the radial dimension of the bore 42. Bit member 30 also includes a centerline axis 43 of rotation. The axial dimension or extent (b) in FIG. 2 of end 46 is about equal to or slightly less than the axial dimension or extent (a) of cap 32 for each and every size of bit as depicted in FIG. 2.

The component parts, which are fabricated from steel suitable for fasteners as known to persons of ordinary skill in the art, are machined, assembled coaxially by inserting end 44 into bore 42 and then fastened together by means of a special silver brazing and heat treating operation as follows:

A silver brazing compound comprised of about 95% by weight silver is applied to the assembled cap 32 (fabricated from 41L40 leaded alloy steel having a Rockwell C hardness of 44–48) and bit member 30 (fabricated from an S2 with additional carbon tool steel austempered and having a Rockwell C hardness of 59–60) at a temperature in the range of about 1850°±10° F. for ten (10) to twelve (12) minutes. The assembly is then cooled at a rate which simultaneously hardens and brazes the components. The rate of cooling typically is in the range of 350°±50° F. per minute to below 400° F. This is followed by tempering the assembly at a temperature of about 425 °±15° F. for at least one (1) hour. The resultant bond between the cap 32 and bit member 30 is extremely resistant to torque about axis 40. (Note: A bismuth steel may be substituted for the leaded alloy steel utilized for the cap 32.)

It should be noted that the bore 42 has a depth approximately equal to the axial length of the opposite or cylindrical end 44 of the bit member 30. The thickness of the cap member 32 is less than one and a half (1½) times the axial extent of that cylindrical end 44 or opposite end of the bit member 30. This minimizes the axial dimension of the combination of bit member 30 and cap member 32 so as to provide a bit construction 34 having a minimal axial extent.

The construction is especially useful in restricted work spaces. Typically, the dimensions, in inches, for a series of TORX fasteners are represented by the following table:

| Bit Size (TORX) | Hexagonal Dimension of Cap 32 (Flat to Flat) | Counter-bore 42 Depth | Transverse Dimension (Diameter of Bore 42) | Axial Dimension of Bit Fastener 34 (a) + (b) |
|---|---|---|---|---|
| T25 | ½" | .410–.390 | .189–.193 | .650 ± .034 |
| T30 | ½" | .410–.390 | .252–.256 | .650 ± .034 |
| T40 | ⅝" | .410–.390 | .283–.287 | .803 ± .034 |
| T45 | ⅝" | .430–.410 | .315–.319 | .868 ± .034 |
| T50 | ⅝" | .475–.455 | .377–.381 | .917 ± .034 |
| T55 | ¾" | .475–.455 | .439–.443 | .937 ± .034 |

It is possible to vary the dimensional characteristics of the bit construction slightly from those taught. However, in order to maintain the restricted work space utility of the bit construction, it is necessary to follow the guidelines for construction set forth above. Among other factors, the axial dimension of the construction is less then about eight (8) times the diameter of the bit member. Thus, while there has been set forth a preferred embodiment of the invention, it is understood that the invention is to only be limited by the following claims and their equivalents.

What is claimed is:

1. A bit construction for use in highly restricted access areas comprising, in combination separately made first and second elements joined by a brazing material to form a single bit by brazing techniques:

said first element consisting essentially of a bit member having a cylindrical shank defining a longitudinal axis for the bit member, said shank having a shaped end for engagement with and driving of a compatible fastener, said shaped end terminating with a planar transverse surface, said bit member also including an opposite cylindrical end, the shaped end having an axial length defined by the axial distance between the transverse surface and the opposite end of the shank, the opposite end of the shank having an axial length approximately equal to the axial length of the shaped end;

said second element consisting essentially of a separate cap member having a centerline axis, a polygonal configuration symmetrical about the centerline axis, and a bore extending partially through the cap along the centerline axis, said bore receiving the opposite, cylindrical end of the bit member, said bore being cylindrical and sized to slidably receive the opposite end of the shank, said bore having a depth approximately equal to the axial length of the opposite end of the bit member, the thickness of the cap member being less than 1.5 times the axial extent of the opposite end of the bit member to thereby minimize the axial dimension of the combination bit member and cap member, said bit member opposite end and said bore both being cylindrical with the bit member opposite end being fully retained in the bore and with the radial dimension of the opposite end being in the range of 0.002" to 0.006" less than the radial dimension of the bore; and said brazing material connecting the elements, said bit member being brazed in the bore of the cup member to define a total axial length of the bit construction of less than two and one half times the axial length of the shaped end.

2. The bit construction of claim 1 wherein the brazing material is a silver brazing compound.

3. The bit construction of claim 1 wherein the brazing material a silver brazing compound having a composition comprising about 95 % silver by weight, which effects a bond between the first and second elements at a temperature in the range of about 1850°±10° F. for a period of about ten (10) to twelve (12) minutes followed by cooling to simultaneously harden and braze the combination at a rate of cooling in the range of 350°±50° F. per minute to below 400° F. and then tempering the combination at a temperature of about 425°±10° F. for a minimum of one (1) hour.

4. The bit construction of claim 1 wherein the axial dimension of the bit construction is less than about eight (8) times the diameter of the cylindrical end of the bit member.

5. A bit construction for use in highly restricted access areas comprising, in combination separately made first and second elements joined by a brazing material to form a single bit:

said first element consisting essentially of a bit member having a cylindrical shank defining a longitudinal axis for the bit member, said shank having a shaped end for engagement with and driving of a compatible fastener, said shaped end terminating with a planar transverse surface, said bit member also including an opposite cylindrical end, the shaped end having an axial length defined by the axial distance between the transverse surface and the opposite end of the shank, the opposite end of the shank having an axial length approximately equal to the axial length of the shaped end;

said second element consisting essentially of a separate cap member having a centerline axis, a polygonal configuration symmetrical about the centerline axis, and a bore extending partially through the cap along the centerline axis, said bore receiving the opposite, cylindrical end of the bit member, said bore being cylindrical and sized to slidably receive the opposite end of the shank, said bore having a depth approximately equal to the axial length of the opposite end of the bit member, the thickness of the cap member being less than 1.5 times the axial extent of the opposite end of the bit member to thereby minimize the axial dimension of the combination bit member and cap member, said bit member opposite end and said bore both being cylindrical with the bit member opposite end being fully retained in the bore and with the radial dimension of the opposite end being in the range of 0.002" to 0.006" less than the radial dimension of the bore; and said brazing material comprising a silver brazing compound connecting the elements, said bit member being brazed in the bore of the cup member to define a total axial length of the bit construction of less than two and one half times the axial length of the shaped ends.

6. A bit construction for use in highly restricted access areas comprising, in combination separately made first and second elements joined by a brazing material to form a single bit:

said first dement consisting essentially of a bit member having a cylindrical shank defining a longitudinal axis for the bit member, said shank having a shaped end for engagement with and driving of a compatible fastener, said shaped end terminating with a planar transverse surface, said bit member also including an opposite cylindrical end, the shaped end having an axial length defined by the axial distance between the transverse surface and the opposite end of the shank, the opposite end of the shank having an axial length approximately equal to the axial length of the shaped end;

said second element consisting essentially of a separate cap member having a centerline axis, a polygonal configuration symmetrical about the centerline axis, and a bore extending partially through the cap along the centerline axis, said bore receiving the opposite, cylindrical end of the bit member, said bore being cylindrical and sized to slidably receive the opposite end of the shank, said bore having a depth approximately equal to the axial length of the opposite end of the bit member, the thickness of the cap member being less than 1.5 times the axial extent of the opposite end of the bit member to thereby minimize the axial dimension of the combination bit member and cap member, said bit member opposite end and said bore both being cylindrical with the bit member opposite end being fully retained in the bore and with the radial dimension of the opposite end being in the range of 0.002" to 0.006" less than the radial dimension of the bore:

said axial dimension of the bit construction being less than about 8 times the diameter of the cylindrical end of the bit member; and said brazing material comprising a silver brazing compound connecting the elements, said bit member being brazed in the bore of the cup member to define a total axial length of the bit construction of less than two and one half times the axial length of the shaped ends.

* * * * *